US007670052B2

(12) United States Patent
Chaturvedi

(10) Patent No.: US 7,670,052 B2
(45) **Date of Patent: *Mar. 2, 2010**

(54) CHILD PROOF RE-CLOSABLE BAG

(76) Inventor: Ashok Chaturvedi, 110, First Floor, Bhanot Corner, Pamposh Enclave, Greater Kailash - 1, New Delhi - 110 043 (IN)

( * ) Notice: Subject to any disclaimer, the term of this patent is extended or adjusted under 35 U.S.C. 154(b) by 1320 days.

This patent is subject to a terminal disclaimer.

(21) Appl. No.: 11/097,609

(22) Filed: Apr. 1, 2005

(65) Prior Publication Data

US 2006/0168779 A1 Aug. 3, 2006

(30) Foreign Application Priority Data

Feb. 3, 2005 (IN) ..... 225/05

(51) Int. Cl.
*B65D 33/16* (2006.01)
*A44B 1/04* (2006.01)

(52) U.S. Cl. ..... 383/64; 24/399; 24/417

(58) Field of Classification Search ..... 383/64; 24/399, 400, 417
See application file for complete search history.

(56) References Cited

U.S. PATENT DOCUMENTS 2,994,469 A * 8/1961 Troup et al. ..... 383/202
5,063,644 A * 11/1991 Herrington et al. ..... 24/400
5,167,608 A * 12/1992 Steffens et al. ..... 493/214
5,836,056 A 11/1998 Porchia et al.
5,871,281 A * 2/1999 Stolmeier et al. ..... 383/64
5,991,980 A * 11/1999 Meager ..... 24/400
6,088,887 A 7/2000 Bois
6,220,754 B1 4/2001 Stiglic et al.
6,287,000 B1 * 9/2001 Buchman ..... 383/5
6,293,701 B1 * 9/2001 Tomic ..... 383/64
6,361,213 B2 * 3/2002 Randall ..... 383/64
6,595,689 B1 * 7/2003 Borchardt et al. ..... 383/64
6,611,996 B2 * 9/2003 Blythe et al. ..... 24/399
6,899,461 B2 * 5/2005 Kasai ..... 383/64
6,915,546 B2 * 7/2005 Kasai ..... 24/30.5 R
7,165,292 B2 * 1/2007 Kasai ..... 24/30.5 R
7,213,303 B1 5/2007 Savicki
2001/0039698 A1 11/2001 Siegel
2006/0269170 A1 * 11/2006 Chaturvedi ..... 383/64
2006/0269171 A1 * 11/2006 Turvey et al. ..... 383/64

FOREIGN PATENT DOCUMENTS

FR 2770493 A1 * 5/1999 ..... 383/64

OTHER PUBLICATIONS

International Search Report, Written Opinion and IPRP in PCT/IN2005/000089.

* cited by examiner

*Primary Examiner*—Jes F Pascua

(57) ABSTRACT

The invention provides for a slider for a child proof slider-zipper assembly having a leading edge, a trailing edge and a top edge with a top surface and a top frame comprising:

a pair of protrusions at the bottom of the leading edge,
a pair of protrusions at the bottom of the trailing edge, and
an opening plow protruding from the top surface of the slider, between the leading edge and trailing edge, and having height not more than the height of the slider
such that the top surface projects upwards from the top frame.

15 Claims, 7 Drawing Sheets

CHILD PROOF RE-CLOSABLE BAG

FIELD OF THE INVENTION

The invention relates to a child proof re-closable bag. More particularly the invention relates to a childproof flexible pouch with a slider zipper.

BACKGROUND OF THE INVENTION

The use of re-closable flexible pouches has seen dramatic increase in the last few years. Heretofore the primary market for bags with slider zippers has been a consumer who purchases empty slider bags and then fills the slider bags with products at home. However, with the increasing popularity of slider bags most manufacturers now tend to package their food and non-food products in slider bags for sale to consumers. The slider bags are a great convenience to the consumer who purchases these product filled bags especially for products of the type where only a portion of the product is used at any given time. The product applications for which slider bags may be used are virtually unlimited.

Plastic bags having zipper closures typically consist of two substantially similar sized sheets of plastic film (usually supplied from a pair of continuous web spools or rolls) which are then sealed together at a lower end of the sheets to form a front layer and a rear layer, with the seal forming a bottom edge of the bag. Alternatively, the plastic bag may be formed by a length of bag film folded upon itself to form a front layer and a rear layer connected by an integral bottom edge defined by the fold. Side edges of the plastic bag are typically sealed using a sealing head. The zipper typically has a two opposing walls with pairs of inter locking members on each side. When the two walls of the zipper are brought together the interlocking members lock and provide a seal to the bag.

The slider device typically includes a separator or plow-type structure in the middle, or at one end, that opens a zipper closure mechanism having male and female interlocking profiled elements or closure profiles when the slider device travels in a first direction along the zipper closure. The sidewalls of the slider device are inwardly tapered from one end to the opposite end so that the sidewalls engage the closure profiles and progressively move them into engagement to close the re-closable package when the slider device is moved along the zipper closure in a direction opposite to the first direction.

The typical slider bags that are being manufactured are airtight as far as solids and powders are concerned. However, the bags currently available are not leak proof. The bags are also not child proof.

The problem of leakage is two fold in that leakage occurs due to the improper sealing of the side edges and also due to improper design of the slider and zipper.

The zipper closure itself is airtight along its length due to the releasable and reusable seal formed by the inter-locked profile. Re-closable packages that include a slider device to more easily open and close the profiles typically face problems in providing a liquid tight seal across the entire length of the zipper closure due to the fact that the slider includes a plow device used to separate the closure profiles as the slider is moved along the length of the zipper closure. Thus a portion of the zipper closure beneath the plow remains open at all times.

Another drawback of existing bags is that they offer no resistance to opening by young children. Prescription drugs, medicines, important documents and a variety of other products need to be kept out of the reach of children. Sliding the slider in the opening direction easily opens re-closable bags with slider zipper presently available.

Co-pending application 1974/DEL/04 overcomes the problem of leakage and provides for a novel slider for a re-closable bag that eliminates the gaps in the zipper at the closing end and the same is incorporated here in entirety. The application provides for a slider that has bottom protrusions at both ends of the slider such that irrespective of the direction of movement of the slider the lower pair of interlocking members of the zipper are sealed. The slider also provides for a separating means or plow that does not extend beyond the upper pair of interlocking members. The separating means is also slanted such that at the end sealing position of the slider the separating means provides an effective seal.

U.S. Pat. No. 6,220,754 provides for one such closure device where the separator finger extends into the closure elements without extending completely through the closure elements. The portion of the closure elements below the separator finger is occluded when the slider is at the first end of the fastening strip. The document however relies on forces acting on the two walls of the zipper due to the position of the slider and the position of the two walls before and after the slider location for this end occlusion. No satisfactory solution is provided to the drawback of the separating means keeping the upper pair of interlocking members open at the end position.

U.S. Pat. No. 5,836,056 also relates to a slider zipper assembly that aims at eliminating the escape gaps at the edges of the zipper when the slider is in the closing position. The slider also has a separating plow that depends from the top surface and is preferably placed at the opening edge of the slider. The separating means penetrates the top pair of interlocking elements but not the bottom pair of inter-locking elements. However, the drawback of the separating plow at the closing end remains.

There is a strong requirement for a re-closable bag that is leak proof and child proof. The invention provides for such a bag.

OBJECTS AND SUMMARY OF THE INVENTION

To meet the aforementioned drawbacks the invention provides for a re-closable flexible bag that is child proof and drip proof.

It is an object of the invention to provide a slider for a zipper of a re-closable bag that makes the bag child proof.

It is an object of the invention to provide a child proof re-closable bag without increasing the cost of the bag.

It is an object of the invention to provide a child proof re-closable bag that can hold solids, liquids and gases.

To meet the aforementioned objectives the invention provides for a slider for a leak proof slider-zipper assembly having a leading edge, a trailing edge and a top edge with a top surface and a top frame comprising:

- a pair of protrusions at the bottom of the leading edge,
- a pair of protrusions at the bottom of the trailing edge, and
- an opening plow protruding from the top surface of the slider, between the leading edge and trailing edge, and having height not more than the height of the slider such that the top surface projects upwards from the top frame.

BRIEF DESCRIPTION OF ACCOMPANYING DRAWINGS

The accompanying drawings illustrate the preferred embodiments of the invention and together with the following detailed description serve to explain the principles of the invention.

DETAILED DESCRIPTION OF THE INVENTION

It will be understood by those skilled in the art that the foregoing general description and the following detailed description are exemplary and explanatory of the invention and are not intended to be restrictive thereof.

At the outset it would be appropriate to mention that leading edge refers to the edge of the slider that leads when the slider is moved to close the zipper. Similarly, trailing edge refers to the edge that leads when the slider is moved to open the zipper.

Through out the patent specification, a convention employed is that in the appended drawings, like numerals denote like components.

To overcome the aforementioned drawbacks of the prior art the invention provides for a slider that has a leading edge, a trailing edge, a top surface and a bottom edge. A plow depends from the top surface of the slider and extends only up to the first interlocking members of a zipper profile. The invention is characterized in that the top surface of the slider projects upwards from the frame of the slider body. The top surface has a separating means or opening plow that depends from it. Thus in the normal position of the slider top surface, moving the slider in the opening or closing direction will not separate the previously inter-locked members of the zipper profile. This makes the re-closable flexible bag child proof. The slider also has closing profiles at both leading and trailing edges at the lower end, such that the bottom inter-locking members of the zipper are sealed irrespective of the direction of movement of the slider. This ensures that the bottom interlocking members are sealed by the slider profile and not opened by the plow, at the closing edge of the zipper profile thereby providing for a leak proof re-closable bag. The invention will now be explained with reference to the following embodiment.

Figure 1:
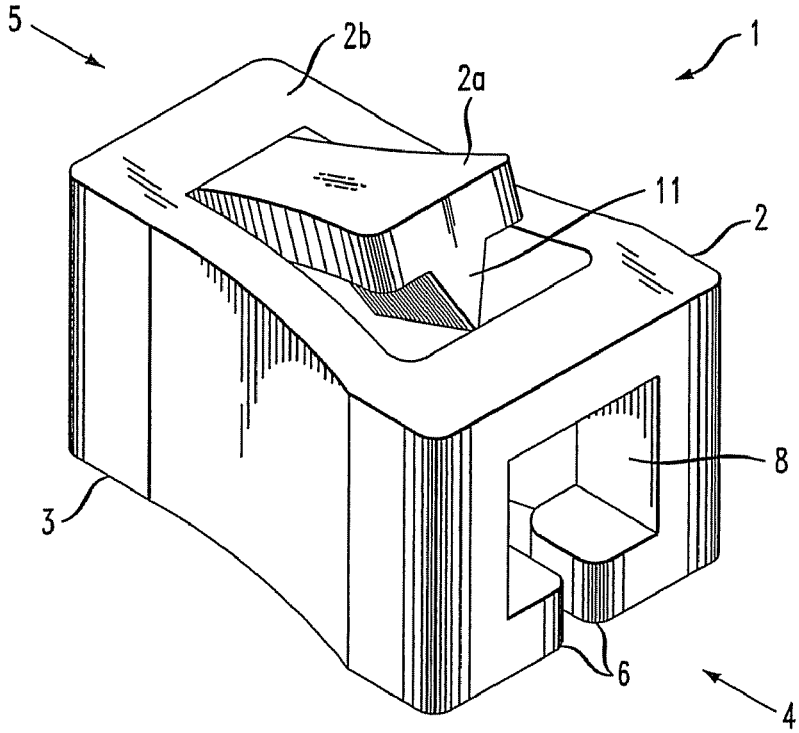
FIG. 1 illustrates a front-top perspective view of the slider in accordance with the invention.

FIG. 1 illustrates a front-top perspective view of the slider (1) having a top edge (2) in accordance with the invention. As shown, the top surface of the slider comprises of a frame (2*b*) and an upwardly projecting top surface (2*a*). The slider has a leading edge (4) and a trailing edge (5). The leading edge (4) has a pair of protrusions (6) at the bottom surface (3) of the slider. An open area (8) is formed between the bottom protrusions (6) and the top surface (2). The two sides of the zipper last pass through these protrusions and the open area (8) when the slider is moved along the zipper in the opening direction. The slider is also provided with a grooved outer surface (7) for better gripping. The grip enables firm holding of the slider even with wet hands.

Figure 2:
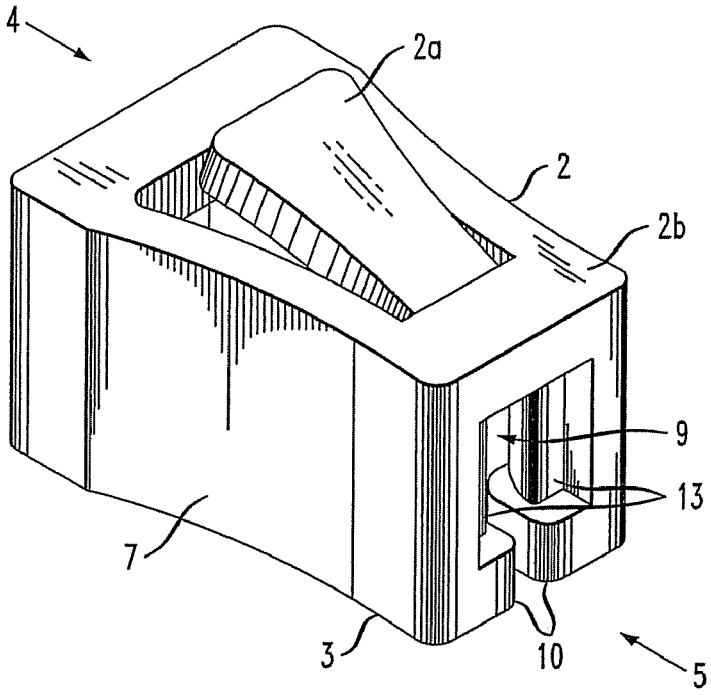
FIG. 2 illustrates a back perspective view of the slider in accordance with the invention.

Referring now to FIG. 2 a back perspective view is shown. As shown the trailing edge (5) also has a pair of protrusions (10) at the bottom surface (3). An open area (9) is formed between the protrusions (10) and the top surface (2) of the slider. The two sides of the zipper last pass through these protrusions and the open area (9) when the slider is moved along the zipper in the closing direction. As may be observed, open area (9) at the trailing edge is smaller than the open area (8) at the leading edge. This may be visualized better in FIG. 3 that depicts the front view of the slider, wherein the opening at (9) measured as (X) is smaller than the opening at (8) measured as (Y). At the bottom surface (3) the gap between the protrusions at the leading edge and the trailing edge (a, b) is substantially the same.

Figure 3:
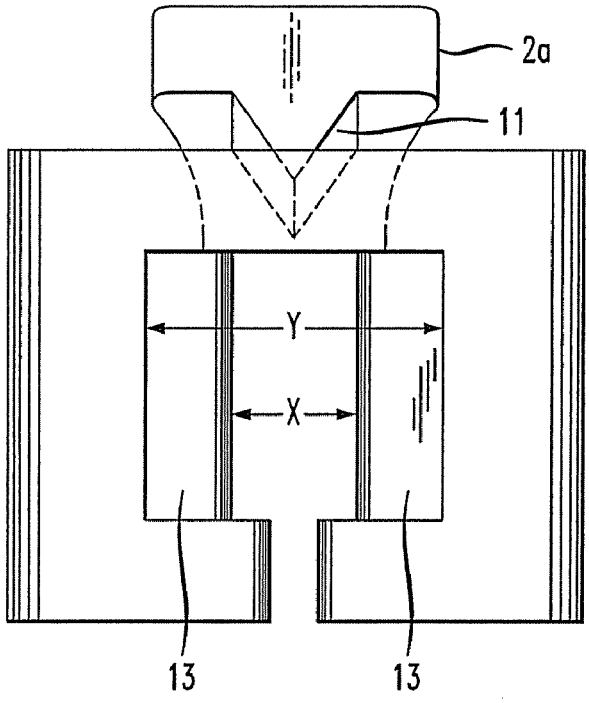
FIG. 3 illustrates a schematic front view of the slider in accordance with the invention.

FIG. 3 shows a central notch or plow (11) that does not extend along the full height of the slider depending down from the top surface (2*a*) of the slider (1). The top surface (2*a*) as shown in the normal or rest position projects upwards such that the plow (11) depending from it does not penetrate the inter-locking members. When the top surface (2*a*) is pressed down towards the slider top frame (2*b*) the plow (11) is lowered into position. The plow height is such that it penetrates only the first pair of interlocking members of the zipper, as explained in detail below. It should be noted that the shape and position of the plow may be varied as per requirement, and the figure serves only to describe an embodiment of the invention.

Figure 4:
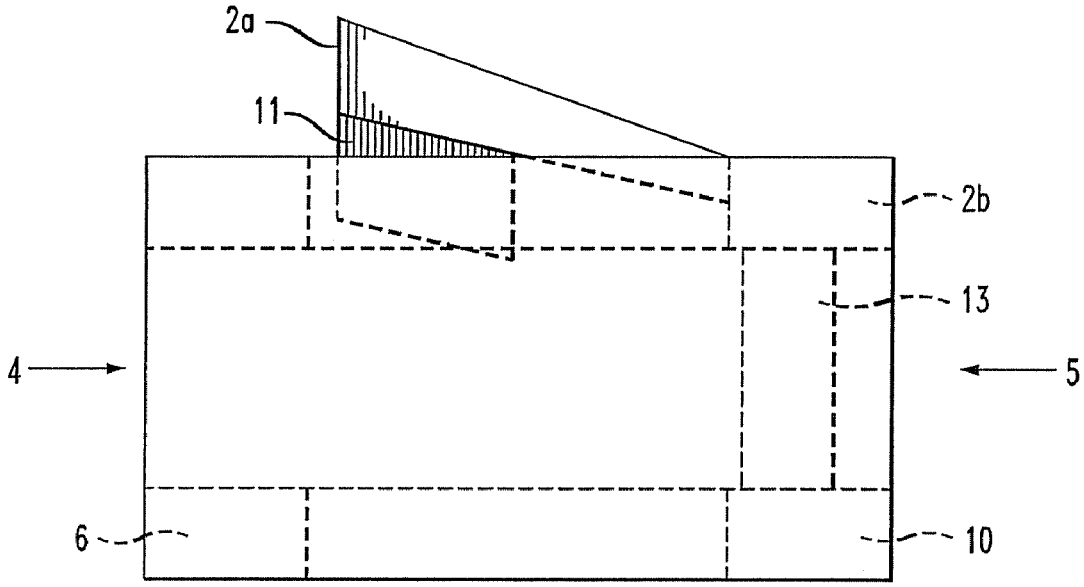
FIG. 4 illustrates a schematic side view of the slider in accordance with the invention.

With reference now to FIG. 4 that illustrates a side view of the slider. The top surface (2*a*) is shown in the rest position projecting upwardly from the top frame (2*b*). The plow (11) in this position of the top surface does not penetrate the interlocking members of the zipper profile. Thus moving the slider in the opening or closing direction will not open the interlocked members of the zipper, as the opening plow does not separate them.

The slider is made of a material such that the top surface (2*a*) when not pressed down tends to return to its original upwardly projecting position.

Figure 5:
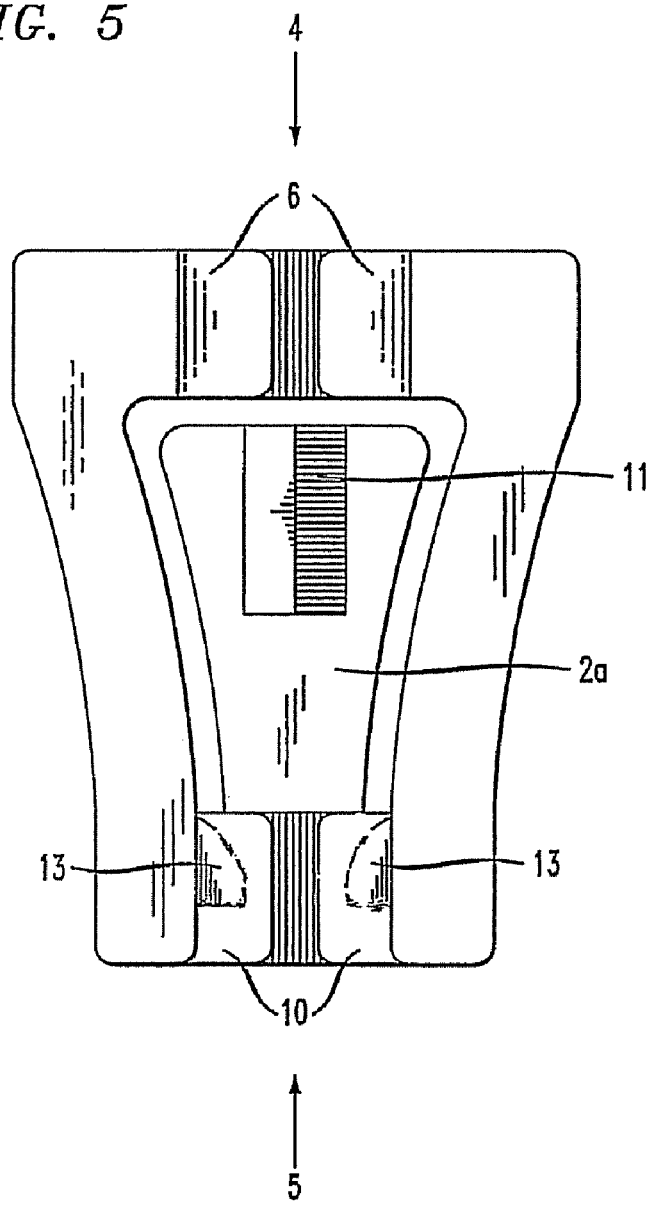
FIG. 5 illustrates a bottom view the slider in accordance with the invention.

With reference now to FIG. 5, as can be seen, the trailing edge (5) has a pair of protrusions (10) at the bottom (3), distance between the protrusions being such that the two sides of the zipper when made to pass through these protrusions will be pressed against each other and consequently sealed together. The trailing edge also has an open area (9), width of the open area (9) being such that the two sides of the zipper are not allowed to separate and the seal is maintained.

The trailing edge (5) in addition to the protrusions (10) at the bottom surface (3) also has protrusions (13) that extend substantially between the top and bottom surfaces. These protrusions (13) may be better visualized in FIG. 3. The protrusions (13) serve to reduce the open area (9) at the trailing edge such that the two sides of the zipper are pressed against each other.

Figure 6:
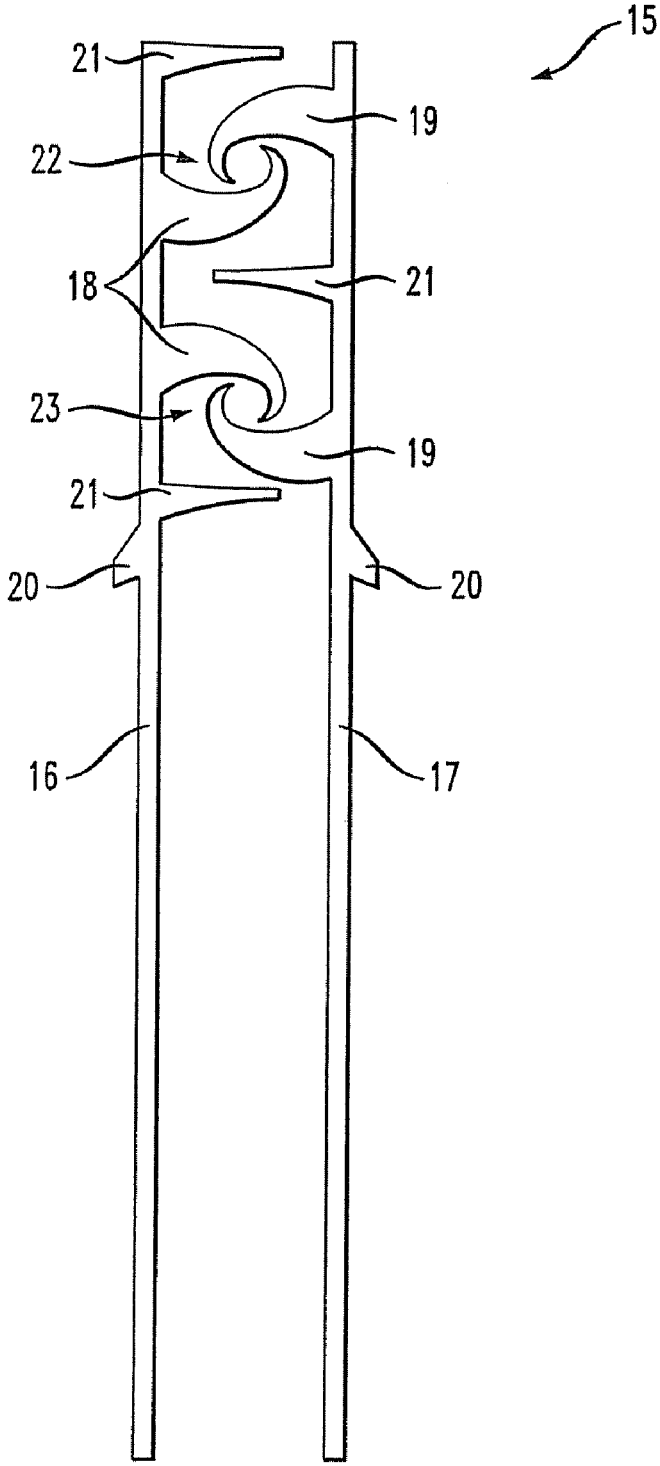
FIG. 6 illustrates a zipper for a re-closable bag in accordance with the invention.
Figure 7:
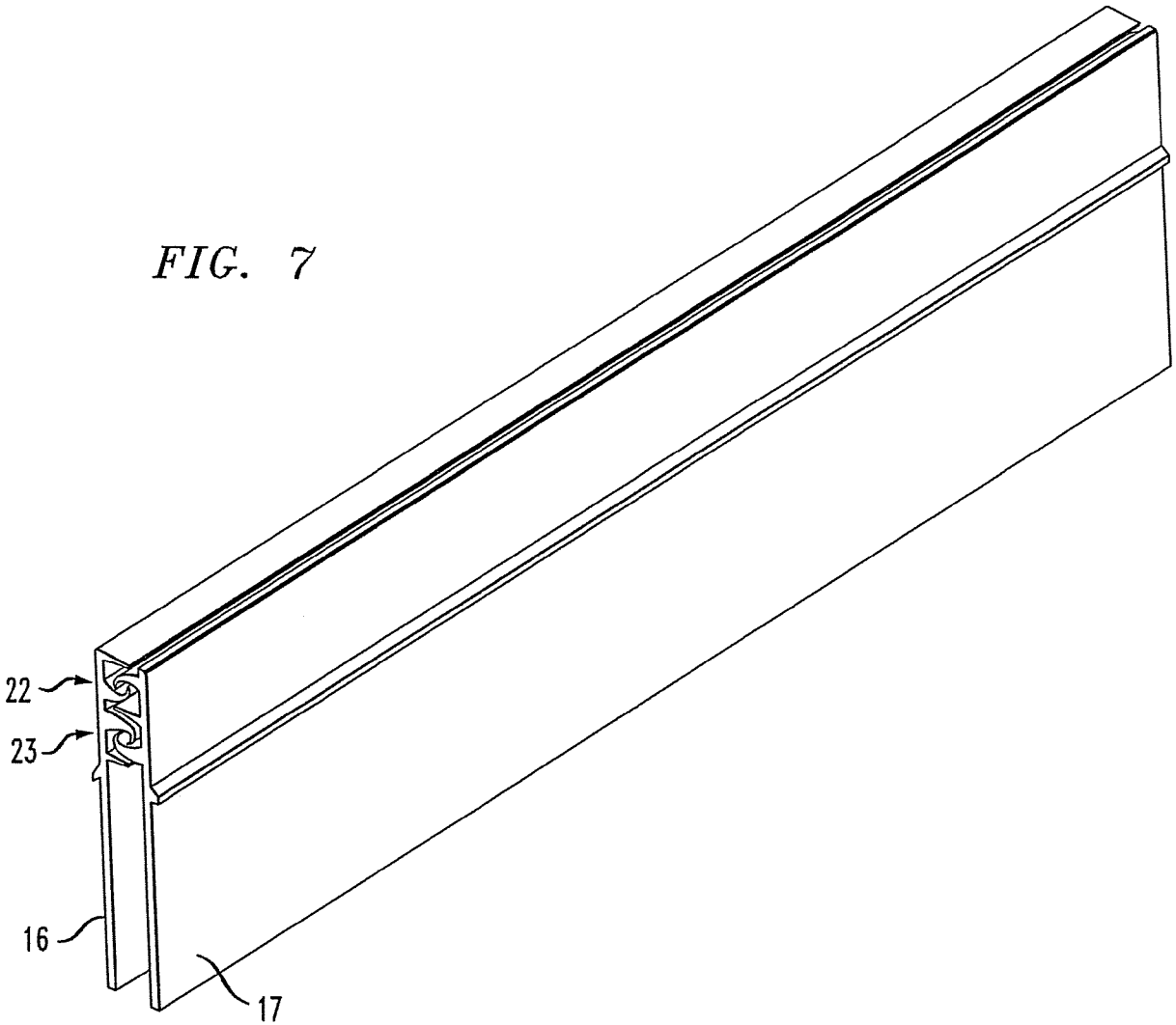
FIG. 7 illustrates a perspective view of the zipper for a re-closable bag in accordance with the invention.

Referring now to FIG. 6 a zipper (15) in accordance with the invention is shown. The zipper has two sides (16,17) having corresponding inter-locking profile elements (18,19). The zipper (15) is also provided with intermediate profile elements (21) that serve to align the two sides (16,17) of the zipper. As can be seen the upper members of inter-locking profile members (18,19) form a first or upper seal (22). Similarly, the bottom members of the interlocking profile members (18,19) form the second or lower seal (23). The zipper is also provided with external projections (20) on both sides (16,17) of the zipper. These projections (20) serve to lock the slider onto the zipper and to prevent the slider from detaching from the zipper. FIG. 7 illustrates another perspective view of the zipper in the sealed condition.

Figures 8, 8A:
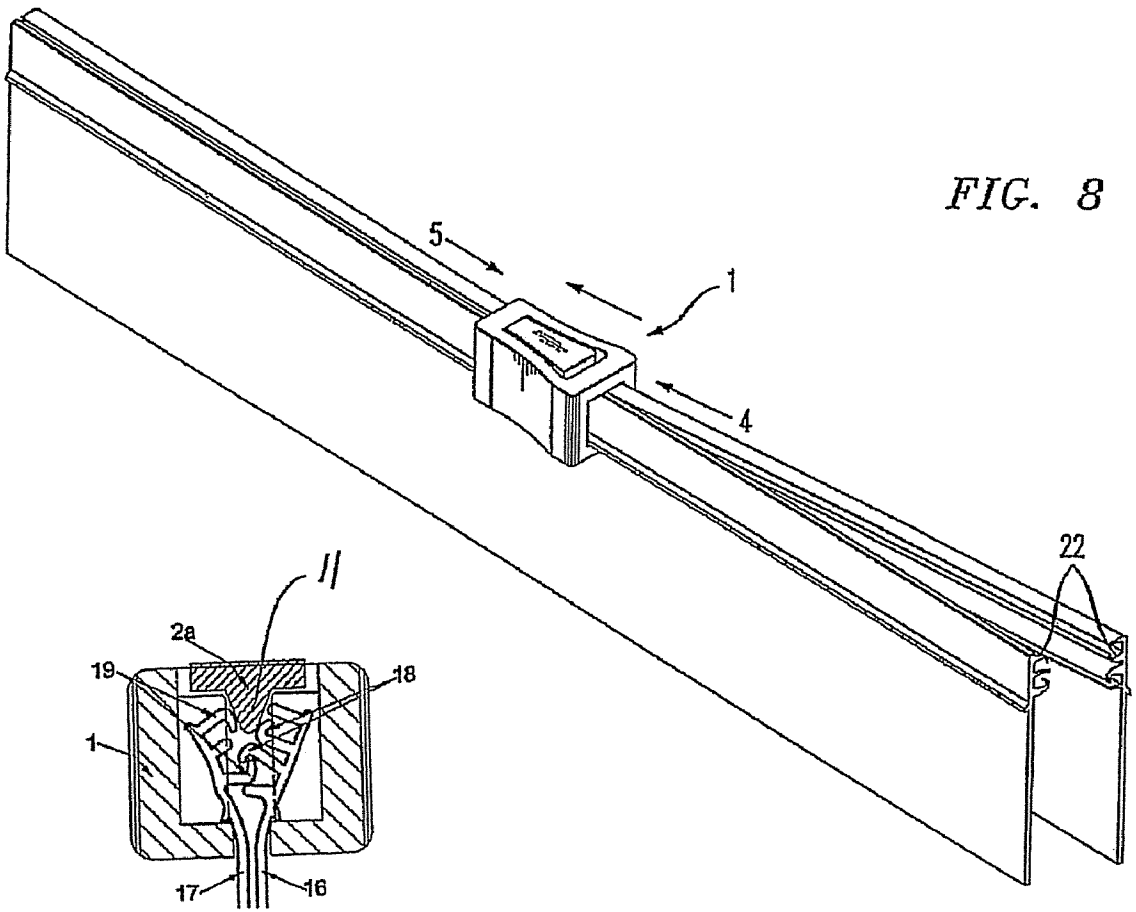
FIG. 8 illustrates the slider during the opening of the zipper.
FIG. 8A illustrates the opening plow of FIG. 8 penetrating a first pair of interlocking members of the zipper.

FIG. 8 illustrates a schematic of the slider (1) fitted on to zipper (15) in accordance with the invention. The opening plow (11) extends only up to the first pair of inter-locking members (22) when depressed. Thus when the slider is made to move over the zipper, without depressing the top surface, the plow does not open the first pair of interlocking members and the bag remains sealed. When the top surface is depressed, as shown, and the slider is moved in the opening direction the plow opens only the first seal (22) of the inter-locking members. The bottom seal (23) of the inter-locking members is opened by virtue of the design, in that, once the upper pair (22) is opened the lower pair tends to separate also.

The invention overcomes this problem by the virtue of the top surface being raised at the closing home position and consequently not separating the sides of the zipper at the closing edge. This ensures that no leakage or escape gaps are formed at the closing edge.

With reference now to FIG. 8 again, the opening action performed by the slider zipper in accordance with this invention is illustrated. As can be seen from the figure, slider (1) is moving towards the left to open the zipper (15).

The opening mechanism may be explained as follows:

The bag using the slider in accordance with this invention will only be opened when the slider is moved in the opening direction with the leading edge following the trailing edge and the top surface pressed down by hand such that the opening plow penetrates the first pair of interlocking members.

During the opening action, the leading edge (4) of the slider follows the trailing edge (5). The trailing edge has bottom protrusions (10) and open area (9), both which ensure that the two sides of the zipper (16,17) remain pressed against each other. Thus when the slider is moved over the zipper in the opening direction, the two sides (16, 17) of the zipper that first pass through the trailing edge remain sealed and both the pairs of inter-locking members (22,23) are locked. The two sides (16,17) then encounter the depressed opening plow (11), wherein the first pair of inter-locking members (22) are separated. The opening plow (11) however does not open the bottom pair of inter-locking members (23). When the slider is moved further ahead, the two sides of the zipper are made to pass through the leading edge (4) of the slider. The leading edge (4) has protrusions (6) at the bottom and an open area (8). On passing through the leading edge, the open area (8) of the slider is such that the opened first pair of inter-locking members (22) are kept open. The protrusions (6) of the leading edge keep the bottom or lower pair of inter-locking members (23) locked. Thus on leaving the leading edge (4) the upper pair (22) is open whereas the bottom pair (23) is locked. However, by virtue of the design and flexibility of the material used for the zipper, the open upper pair (22) causes the lower pair (23) also to open thereby opening the zipper.

Figure 9:
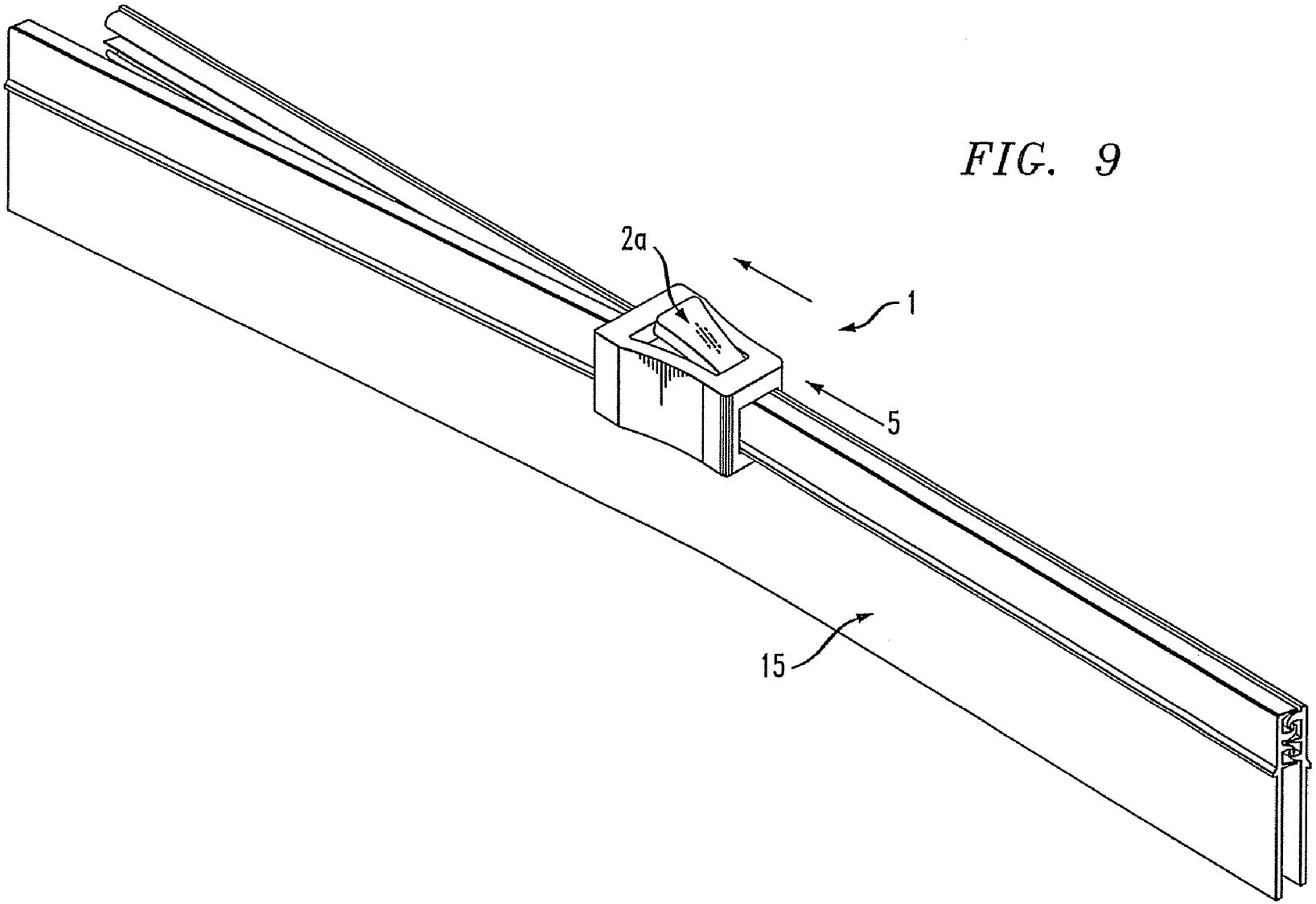
FIG. 9 illustrates the slider during the closing of the zipper.

FIG. 9 illustrates the closing action performed by the slider zipper in accordance with this invention. As can be seen from the figure, slider (1) is moving towards the left to close the zipper (15). The opening plow (11) is in the normal position, not depressed, and does not penetrate the first or upper pair of inter-locking members (22).

The closing mechanism may be described as follows:

It should be noted that for the bag to be closed the top surface of the slider does not have to be pressed down.

During the closing action, the trailing edge (5) of the slider follows the leading edge (4). The leading edge has bottom protrusions (6) and open area (8). The protrusions (6) ensure that the two sides of the zipper (16,17) remain pressed against each other at the lower pair of inter-locking members (23). Thus when the slider is moved over the zipper in the closing direction, the two sides (16, 17) of the zipper first pass through the leading edge, the lower or bottom pair of inter-locking member (23) is locked, while due to the substantially larger open area (8) the upper pair of inter-locking members (22) remain open. When the slider is moved further ahead, the two sides of the zipper are made to pass through the trailing edge (5) of the slider. The trailing edge (5) has protrusions (10) at the bottom and an open area (9). On passing through the trailing edge, the open area (9) of the slider is such that the opened first pair of inter-locking members (22) is now locked and the sealing is complete. The protrusions (10) of the trailing edge keep the bottom or lower pair of inter-locking members (23) locked. Thus on leaving the trailing edge (5) both the pairs of inter-locking members (22, 23) are locked giving a complete seal.

At the closing home position, the leading edge (4) of the slider comes in contact with the end seal and also partially overlaps it. The opening plow (11) does not interfere with the inter-locking members, as the top surface is not depressed down. The leading edge (4) of the slider with its bottom protrusions (6) closes the lower pair of inter-locking members (23) at the edge near the end seal (35).

Thus, the zipper when closed, is completely sealed along the bottom pair of inter-locking members (23) providing a drip free re-closable flexible pouch. The upper pair of inter-locking members (22) is also sealed throughout, as the opening plow does not cause any separation.

Furthermore, to open the bag the top surface must be depressed down and retained in that position and then slide the slider in a direction such that the leading edge trails the trailing edge. This application of thought to the opening process makes the re-closable bag in accordance with this invention child proof.

It will readily be appreciated by those skilled in the art that the present invention is not limited to the specific embodiments herein shown. Thus variations may be made within the scope and spirit of the accompanying claims without sacrificing the principal advantages of the invention.

I claim:

1. A slider and zipper assembly, the slider having a leading edge, a trailing edge and a top edge with a top surface and a top frame, comprising:

a pair of protrusions at the trailing edge pressing on opposite sides of a zipper of the slider and zipper assembly to close the zipper upon moving the slider over the zipper in a closing direction, and an opening plow on the top surface and protruding downward between the leading edge and the trailing edge, wherein the top surface is positioned such that it originally projects upward from the top frame, and wherein the top surface is depressed downward for the opening plow to penetrate a pair of inter-locked inter-locking members on the opposite sides of the zipper, and for the opening plow to separate the pair of inter-locking members and open the zipper by moving the slider over the zipper in an opening direction while the top surface is being depressed downward, and wherein when the top surface is not depressed downward, the top surface tends to return to its original upwardly projecting position.

2. A slider and zipper assembly as claimed in claim 1 comprising:

the pair of inter-locking members comprise a first pair, and a second pair of inter-locking members are on the opposite sides of the zipper, wherein the height of the opening plow is such that it penetrates only the first pair while the top surface is depressed to open the first pair, and flexibility of the zipper and an open first pair causes the second pair to separate thereby opening the zipper.

3. A slider and zipper assembly as claimed in claim 2 wherein further protrusions at the leading edge press on the opposite sides of the zipper to inter-lock the second pair of inter-locking members while the slider is moved in the closing direction, and an open area is formed between the protrusions at the leading edge and the top surface of the slider.

4. A slider and zipper assembly as claimed in claim 2 wherein further protrusions at the leading edge press on the opposite sides of the zipper to inter-lock the second pair of inter-locking members while the slider is moved in the closing direction, a first open area at the leading edge is formed between the top surface of the slider and the protrusions at the leading edge, and a second open area at the trailing edge is formed between the protrusions at the trailing edge and the top surface of the slider.

5. A slider and zipper assembly as claimed in claim 2 wherein further protrusions at the leading edge press on the opposite sides of the zipper to inter-lock a second pair of inter-locking members on the opposite sides of the zipper while the slider is moved in the closing direction, the opposite sides of the zipper passing between the further protrusions are pressed by the further protrusions.

6. A slider and zipper assembly as claimed in claim 1, comprising:

the leading edge has a first open area for an open zipper to pass through, and has a second pair of protrusions pressing the opposite sides of the zipper to inter-lock a second pair of inter-locking members on the opposite sides of the zipper while the slider is moved in a closing direction, and the trailing edge has a second open area for a closed zipper to pass through, wherein the first open area is larger than the second open area.

7. A slider and zipper assembly as claimed in claim 1 wherein the slider has grooved surfaces on its sides to provide a better grip.

8. A slider and zipper assembly as claimed in claim 1 wherein the opposite sides of the zipper passing between the protrusions are pressed by the protrusions.

9. A slider and zipper assembly as claimed in claim 1 wherein the opening plow does not extend along the full height of the slider.

10. A slider and zipper assembly as claimed in claim 1 wherein respective protrusions at the leading edge and the pair of protrusions at the trailing edge close the zipper to inter-lock the second pair of inter-locking members and provide respective seals at the leading edge and trailing edge.

11. A slider and zipper assembly as claimed in claim 1 wherein the zipper has external projections to lock the slider onto the zipper.

12. A re-closable flexible package comprising:

a pair of side panels joined along a first side edge and a second side edge, the panels defining a mouth providing access to a package interior, a zipper positioned along the mouth of the package for selectively opening and closing the package mouth, the zipper including a first pair of inter-locking members and a second pair of inter-locking members below the first pair, a slider over the zipper having a leading edge and a trailing edge and a top edge with a top surface and a top frame, the slider comprising a pair of protrusions at the leading edge, a pair of protrusions at the trailing edge, and an opening plow on the top surface and protruding downward between the leading edge and the trailing edge, wherein the top surface is positioned such that it originally projects upwards from the top frame, wherein the top surface is depressed downward for the opening plow to penetrate the first pair of inter-locked inter-locking members on the opposite sides of the zipper, and for the opening plow to separate the first pair of inter-locking members by moving the slider over the zipper in an opening direction while the top surface is being depressed downward, wherein when the top surface is not depressed downward, the top surface tends to return to its original upwardly projecting position and flexibility of the zipper and an open first pair causes the second pair to separate thereby opening the zipper.

13. A re-closable flexible package as claimed in claim 12 wherein the zipper has external protrusions to lock the slider onto the zipper.

14. A re-closable flexible package as claimed in claim 12 wherein the opening plow does not extend along the full height of the slider.

15. A re-closable flexible package as claimed in claim 12 wherein the respective protrusions at the leading edge and trailing edge close the zipper to inter-lock the second pair of inter-locking members and provide respective seals at the leading edge and trailing edge.

* * * * *